United States Patent [19]

Strom et al.

[11] 4,103,281

[45] Jul. 25, 1978

[54] MEASURING-WHILE-DRILLING SYSTEM HAVING MOTOR SPEED DETECTION DURING ENCODING

[75] Inventors: Gerald A. Strom, Dayton; James I. Bernard, Houston, both of Tex.

[73] Assignee: Schlumberger Technology Corporation, New York, N.Y.

[21] Appl. No.: 727,687

[22] Filed: Sep. 29, 1976

[51] Int. Cl.[2] ..... G01V 1/40

[52] U.S. Cl. ..... 340/18 LD; 318/314; 340/18 NC

[58] Field of Search ..... 340/18 NC, 18 LD; 318/312, 314, 318

[56] References Cited

U.S. PATENT DOCUMENTS

| | | | |
|---|---|---|---|
| 3,176,208 | 3/1965 | Gifft | 318/314 |
| 3,331,006 | 7/1967 | Strand et al. | 318/318 |
| 3,789,355 | 1/1974 | Patton | 340/18 LD |
| 3,820,063 | 6/1974 | Sexton et al. | 340/18 LD |
| 3,828,234 | 8/1974 | Goldberg | 318/314 |
| 3,950,682 | 4/1976 | Dohanick, Jr. | 318/314 |
| 3,974,428 | 8/1976 | Hafle | 318/314 |

*Primary Examiner*—Howard A. Birmiel
*Attorney, Agent, or Firm*—David L. Moseley; Sherman, William R.; Edward M. Roney

[57] ABSTRACT

A measuring-while-drilling system includes motor speed detection during encoding for returning control to a phase locked loop circuit when the rate of an acoustic signal generator has precisely returned to a carrier frequency producing rate. The measuring-while-drilling system includes the acoustic generator which has a moveable member disposed within the flow of drilling fluid and which is driven at speeds for imparting to the drilling fluid an acoustic signal having phase states representative of encoded data signals derived from measured downhole conditions. The phase locked loop circuit drives the moveable member at a substantially constant rate to thereby effect a substantially constant carrier frequency in the acoustic signal. A frequency changing control circuit is provided for temporarily changing the rate of the member to effect a predetermined phase change in the carrier signal according to the data. The rate of movement of the member is changed in a first direction until a prescribed amount of the predetermind phase change is achieved, and the rate of movement is changed in the opposite direction for accumulating the remainder of the predetermined phase change. A rate detection circuit monitors a signal representing the rate of movement of the member for generating an end-of-return signal which stops the rate of movement in the opposite direction precisely when the rate of the member has been returned to the constant frequency producing rate.

25 Claims, 5 Drawing Figures

142 MOTOR FREQUENCY DETECTOR
144
145
146
147
148
149
152
160
162
164
166
168
170
172
174
176
180
182
184
186
187
188
TS
TPA
WM
24 KHz REF.
ENABLE
MFD
U/D
PE
P0
P1
P2
P3
CO
CI
S
R
C
D
Q
X
Y
Z

157
PLL CONTROL CIRCUIT
145
$\bar{X}$
195
TARGETING PHASE ACCUMULATOR
TARGETING PHASE ACCUMULATOR PRESET COUNTER
SP
220
UP/DOWN STEERING LOGIC
210
214
217
Cp
212
216
TARGETING COMPENSATING REFERENCE FREQUENCY
WTC
222
CORRECTION PULSE GENERATOR
EP
ERROR PULSE GAIN
190
TARGETING CORRECTION
149
194
PHASE ACCUMULATOR
TRANSITION START
Ts
192
COMPARATOR
200
202
204
196
REF. COUNTER
TACH. COUNTER
198
WMR
150
WM

MEASURING-WHILE-DRILLING SYSTEM HAVING MOTOR SPEED DETECTION DURING ENCODING

BACKGROUND OF THE INVENTION

This invention relates to data measuring of downhole conditions within wells during drilling and more particularly relates to apparatus and methods for telemetering data in such operations using an acoustic signal transmitted through the drilling fluid during drilling.

Various logging-while-drilling techniques for telemetering data representing downhole conditions during drilling of a well have been suggested. One approach uses a technique which imparts an acoustic signal, modulated according to the sensed conditions, to the drilling fluid, i.e., the drilling mud, for transmission to the entrance of the well where it is received and decoded by uphole electronics circuitry. This basic technique is described in detail in U.S. Pat. No. 3,309,656, issued Mar. 14, 1967 to Godbey entitled "Logging-While-Drilling System." In this system the modulated signal is applied to the drilling fluid using an acoustic signal generator which includes a movable member for selectively interrupting the drilling fluid. At least part of the flow of the drilling fluid is through the acoustic generator, and the movable member selectively impedes this flow, transmitting a continuous acoustic wave uphole within the drilling fluid.

The acoustic signal is preferably phase shift keyed modulated, as disclosed in U.S. Pat. No. 3,789,355, issued Jan. 29, 1974, to Patton entitled "Method and Apparatus For Logging While Drilling." According to phase shift keyed (PSK) modulation, the data derived in response to the sensed downhole condition is initially encoded into binary format, and the acoustic signal generator is driven at speeds so that the phase of a constant frequency carrier wave generated in the drilling fluid is indicative of the data. In particular, a non-return to zero type PSK mode is used wherein the phase of the carrier signal is changed only upon each receipt of data of a predetermined value. For example, for data encoded in binary, the phase of the carrier wave may be changed for an occurrence of a logic 1 data bit.

Ideally the phase change of the carrier signal would be instantaneous upon occurrence of the data of the particular value. This is because the downhole telemetering unit is continuously transmitting data to the uphole receiving instruments where the data in turn is continuously decoded. Any delays in effecting the phase change and in returning the acoustic signal to its carrier frequency introduce errors and/or inefficiencies into the system.

As a practical matter, however, the phase of the acoustic signal cannot be changed instantaneously in response to data of the predetermined value. Inherent delays are introduced by the physics of the system. The motor control circuitry which operates the motor-driven acoustic generator is adjusted accordingly to effect optimum response of the generator. Past proposals, such as the above-referenced Godbey and Patton patent, and in U.S. Pat. No. 3,820,063, issued June 25, 1974, to Sexton et al. entitled "Logging While Drilling Encoder," have proposed several circuits for implementing the motor control circuitry. In the Patton and Sexton et al. patents, the speed of the motor was to be temporarily varied such that, upon returning of the motor speed back to the carrier frequency producing speed, the desired amount of phase change would be accumulated. In the Sexton et al. patent, this was accomplished by varying the speed of the motor in a first direction until a predetermined amount of phase shift had been accumulated. The motor speed was then returned in the other direction to the carrier frequency producing speed for a pretermined duration of time, thereby attempting to accumulate the remainder of the desired amount of the phase change.

The above proposals lacked preciseness in returning the speed of the acoustic generator drive motor to the conduit carrier frequency producing speed (the carrier speed) during the phase changing (during modulation). The proposals appeared to suggest tuning of the respective systems such that the return approximated the accumulating of the desired amount of change and approximated terminating the return when the speed of the motor had reached the carrier speed. The proposals, however, failed to detect the actual speed of the motor which would allow termination of the return precisely upon reaching the carrier speed. In failing to detect the actual motor speed, the proposals failed in providing a system which would allow the return to be in the shortest possible period of time; i.e., failed in providing a system which would allow the driving of the drive motor at maximum excitation yet which would obviate undershoot or overshoot of the carrier speed. The proposals relied on a separate phase and frequency adjusting and maintaining circuitry to adjust the phase and frequency to the proper values after approximate return to carrier speed to account for the undershoot and overshoot. Such adjusting and maintaining circuitry, however, required a relatively long time to change the motor speed any substantial amount, thereby failing to minimize the period of the return. By failing to minimize the period of the return, the proposals either allowed inaccuracies to be introduced into the system or provided an unnecessarily slow encoding/data transmission system.

More specifically, in the system proposed in the Sexton et al. patent, the speed was returned by applying a predetermined level of excitation of the drive motor for a fixed, predetermined duration of time. After expiration of the predetermined duration of time, control of the motor speed was returned to the phase and frequency adjusting and maintaining circuitry, regardless of the total amount of phase accumulated or of the actual speed of the drive motor.

SUMMARY OF THE INVENTION

The above noted and other disadvantages are overcome by providing rate detection during modulation and by stopping the changing of the rate of movement of the moveable member when it reachieves the constant frequency producing rate. By rapidly returning the rate to the constant frequency producing rate at an acceleration which is a function having a rate of change which is changing with time and by stopping the return precisely at the constant frequency, the return to the constant rate at the proper phase is effected in a minimum time period. This is due to minimizing the correction otherwise required for precisely returning it to the constant frequency rate at the proper phase. By adjusting the beginning of the period during which the rate is returned to the constant frequency rate according to loading conditions, the desired amount of phase shift accumulated thereby is more nearly achieved when the rate is initially returned to the constant frequency rate.

According to the invention, a measuring-while-drilling system includes a motor which is excited to drive an acoustic generator having a moveable member disposed for selectively interrupting the well fluid. The generator is driven at speeds for imparting to the well fluid an acoustic signal having modulated phase states representative of data derived from measured downhole conditions. The system further includes a motor control circuit having circuitry: (1) for driving the motor at a substantially constant speed to provide and maintain a carrier frequency and reference phase in the acoustic signal, and (2) for temporarily changing the speed of the motor to effect a predetermined amount of phase change in the carrier frequency according to the downhole derived data. The frequency and phase maintaining circuitry preferably comprises a phase locked loop circuitry and, upon occurrence of data, motor speed control is taken away from the frequency and phase maintaining circuitry. Control is then given to the speed changing circuitry, and the speed of the motor is temporarily changed from the constant frequency producing speed to a different speed value. When a prescribed portion of the predetermined amount is accumulated according to a pre-programmed function, the speed of the motor is then returned to the carrier frequency producing speed, and control is returned to the frequency and phase maintaining circuitry.

During modulation, the speed of the motor is changed so that the rate of movement of the member is changed in a first direction until a prescribed amount of the predetermined phase change is achieved and is then, in response to the occurrence of a control signal, changed in the opposite direction for accumulating at least part of the remainder of the predetermined phase change. According to an oustanding feature of the invention, the return rate change is terminated upon the generation of an end-of-return signal when the rate of the member achieves precisely the constant frequency producing rate.

For generating the control signal, the motor control circuit includes a differential integrating circuit which is responsive (1) to a carrier frequency signal representing the value of the constant carrier frequency intregrated over a time period beginning substantially upon the occurrence of one data signal, and (2) to a drive frequency signal representative of the value of the instantaneous speed of the generator integrated over the time period. The differential integrating circuit generates the control signal when a predetermined value is exceeded by the difference between (1) the carrier frequency signal integrated over the time period, and (2) the drive frequency signal integrated over the time period.

For generating the end-of-return signal, the motor control circuit includes a rate detector which is coupled for detecting the speed of the motor and thus for detecting the rate of the movement of the member. It generates the end-of-return signal when the speed of the motor becomes equal to the carrier frequency producing speed.

According to another feature of the invention, the speed changing circuitry includes a ramp signal generator which excites the motor with a function which changes with time for rapidly returning the rate of movement of the member back to the carrier frequency. This assures that the period necessary for return of the rate to the carrier frequency is in a minimum time, yet, due to the motor speed detection and to the terminating of the return movement upon generation of the end-of-return signal, the rapid return does not cause overshooting of the carrier frequency. This assures the overall minimum time required for the frequency and phase maintaining circuitry to properly lock the phase and frequency of the acoustic signal.

According to another feature of the invention, the differential integrating circuit includes a presettable accumulator circuit which is programmable for establishing the predetermned value in response to phase accumulated (as indicated by motor speeds) during a previously occurring modulation of the acoustic signal. A targeting compensation signal generator is coupled to the motor for providing a targeting compensation signal which presets the accumulator circuit according to whether loading conditions on the motor have caused a relative increase or decrease in the speed of the motor as the speed is returned to the carrier frequency producing speed. The targeting compensation signal adjusts the predetermined value of the presettable accumulator circuit accordingly so that, upon generation of the end-of-return signal, the desired amount of total phase change has more nearly been accomplished, thereby further reducing the overall time period required for the frequency and phase maintaining circuitry to bring the acoustic signal into phase and frequency lock.

Accordingly, it is a general object of the present invention to provide a new and improved apparatus and method for telemetering downhole, well drilling data during drilling which features motor speed detection during encoding of the acoustic signal.

BRIEF DESCRIPTION OF THE DRAWINGS

The above and other features and advantages of the present invention will become more apparent in view of the following description of a preferred embodiment when read in conjunction with the drawings, wherein.

DESCRIPTION OF A PREFERRED EMBODIMENT

Figure 1:
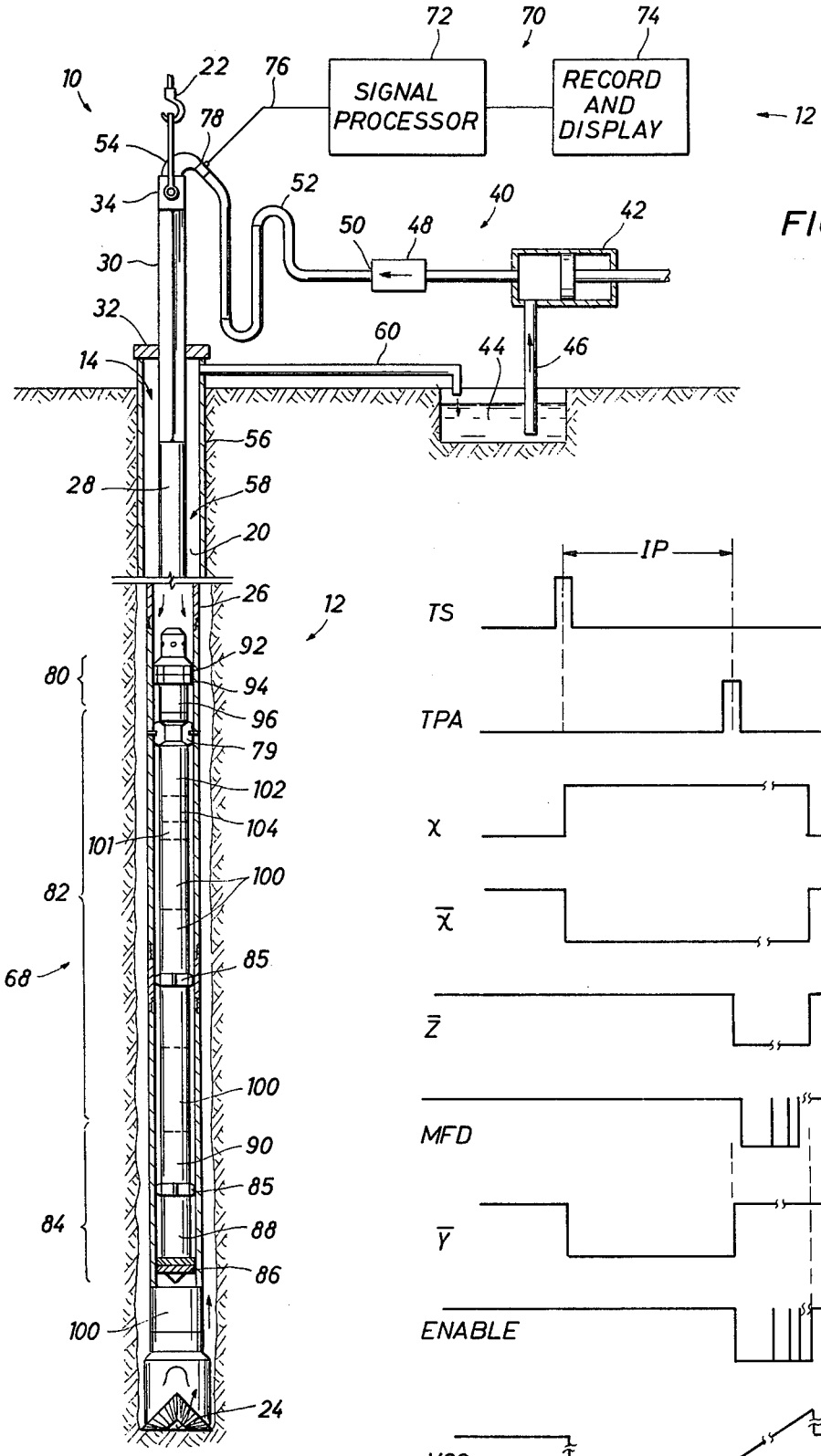
FIG. 1 is a schematic drawing showing a general well drilling and data measuring system according to the invention.

Referring now to the drawings, FIG. 1 shows a well drilling system 10 in association with a measuring-while-drilling system 12 embodying the invention. For convenience, FIG. 1 depicts a land based drilling system, but it is understood that a sea based system is also contemplated.

As the drilling system 10 drills a well-defining borehole 14, the measuring-while drilling system 12 senses downhole conditions within the well and generates an acoustic signal which is modulated according to data generated to represent the downhole conditions. The acoustic signal is imparted to drilling fluid, commonly referred to as drilling mud, in which the signal is communicated to the surface of the borehole 14. At or near the surface of the borehole 14 the acoustic signal is detected and processed to provide recordable data representative of the downhole conditions. This basic system is now well-known and is described in detail in the above referred U.S. Pat. No. 3,309,656 to Godbey which is hereby incorporated by reference.

The drilling system 10 is conventional and includes a drill string 20 and a supporting derrick (not shown) represented by a hook 22 which supports the drill string 20 within the borehole 14.

The drill string 20 includes a bit 24, one or more drill collars 26, and a length of drill pipe 28 extending into the hole. The pipe 28 is coupled to a kelly 30 which extends through a rotary drive mechanism 32. Actuation of the rotary drive mechanism 32 (by equipment not shown) rotates the kelly 30 which in turn rotates the drill pipe 28 and the bit 24. The kelly 30 is supported by the hook via a swivel 34.

Positioned near the entrance to the borehole 14 is a conventional drilling fluid circulating system 40 which circulates drilling fluid, commonly referred to as mud, downwardly into the borehole 14. The mud is circulated downwardly through the drill pipe 28 during drilling, exits through jets in the bit 24 into the annulus and returns uphole where it is received by the system 40. The circulating system 40 includes a mud pump 42 coupled to receive the mud from a mud pit 44 via a length of tubing 46. A desurger 48 is coupled to the exit end of the mud pump 42 for removing any surges in the flow of the mud from the pump 42, thereby supplying a continuous flow of mud at its output orifice 50. A mud line 52 couples the output orifice 50 of the desurger to the kelly 30 via a gooseneck 54 coupled to the swivel 34.

Mud returning from downhole exits near the mouth of the borehole 14 from an aperture in a casing 56 which provides a flow passage 58 between the walls of the borehole 14 and the drill pipe 28. A mud return line 60 transfers the returning mud from the aperture in the casing 56 into the mud pit 44 for recirculation.

The measuring-while-drilling system 12 includes a downhole acoustic signal generating unit 68 and an uphole data receiving and decoding system 70. The acoustic signal generating unit 68 senses the downhole conditions and imparts encoded acoustic signals to the drilling fluid. The acoustic signal is transmitted by the drilling fluid to the uphole receiving and decoding system 70 for processing and display.

To this end, the receiving and decoding system 70 includes a signal processor 72 and a record and display unit 74. The processor 72 is coupled by a line 76 and a pressure transducer 78 to the mud lines 52. The encoded acoustic signal transmitted uphole by the drilling fluid is monitored by the transducer 78, which in turn generates electrical signals to the processor 72. These electrical signals are decoded into meansingful information representative of the downhole conditions, and the decoded information is recorded and displayed by the unit 74.

One such uphole data receiving and decoding system 70 is described in U.S. Pat. No. 3,886,495 to Sexton et al., issued May 27, 1975, entitled "Uphole Receiver For Logging-While-Drilling System, " which is hereby incorporated by reference.

The downhole acoustic signal generating unit 68 is supported within one of the downhole drill collars 26 by a suspension mechanism 79 and generally includes a modulator 80 having at least part of the flow of the mud passing through it. The modulator 80 is controllably driven for selectively interrupting the flow of the drilling fluid to thereby impart the acoustic signal to the mud. A cartridge 82 is provided for sensing the various downhole conditions and for driving the modulator 80 accordingly. The generating unit 68 also includes a power supply 84 for energizing the cartridge 82. A plurality of centralizers 85 are provided to position the modulator 80, the cartridge 82, and the supply 84 centrally within the collar 26.

The power supply 84 is now well-known in the art and includes a turbine 86 positioned within the flow of the drilling fluid to drive the rotor of an alternator 88. A voltage regulator 90 regulates the output voltage of the alternator 88 to a proper value for use by the cartridge 82.

The modulator 80 is also now well-known in the art. It includes a movable member in the form of a rotor 92 which is rotatably mounted on a stator 94. At least part of the flow of the mud passes through apertures in the rotor 92 and in the stator 94, and rotation of the rotor selectively interrupts flow of the drilling fluid when the apertures are in misalignment, thereby imparting the acoustic signal to the drilling fluid. The rotor 92 is coupled to gear reduction drive linkage 96 which drives the rotor. The cartridge 82 is operably connected to the linkage 96 for rotating the rotor 92 at speeds producing an acoustic signal in the drilling fluid having (1) a substantially constant carrier frequency which defines a reference phase value, and (2) a selectively produced phase shift relative to the reference phase value at the carrier frequency. The phase shift is indicative of encoded data values representing the measured downhole conditions.

In the preferred embodiment the drive linkage 96 and the designs of the rotor 92 and stator 94 are chosen to generate 1/5 of a carrier cycle in the acoustic signal for each revolution of the motor 102.

A suitable modulator 80 is shown and described in detail in U.S. Pat. No. 3,764,970 to Manning which is assigned to the assignee of this invention. Other suitable modulators 80 are described in the above-referenced Patton and Godbey patents, as well as in "Logging-While-Drilling Tool" by Patton et al., U.S. Pat. No. 3,792,429, issued Feb. 12, 1974, and in "Logging-While-Drilling Tool" by Sexton et al., U.S. Pat. No. 3,770,006, issued Nov. 6, 1973, all of which are hereby incorporated by reference.

Referring now to the cartridge 82, it includes one or more sensors 100 and associated data encoding circuitry 101 for measuring the downhole conditions and generating encoded data signals representative thereof. For example, the sensors 100 may be provided for monitoring drilling parameters such as the direction of the hole (azimuth of hole deviation), weight on bit, torque, etc. The sensors 100 may be provided for monitoring safety parameters, such as for detecting over pressure zones (resistivity measurements) and fluid entry characteristics by measuring the temperature of the drilling mud within the annulus 58. Additionally, radiation sensors may be provided, such as gamma ray sensitive sensors for discriminating between shale and sand and for depth correlation.

The data encoding circuitry 101 is conventional and includes a multiplex arrangement for encoding the signals from the sensors into binary and then serially transmitting them over a data line. A suitable multiplex encoder arrangement is disclosed in detail in the above referenced Sexton et al. patent, U.S. Pat. No. 3,820,063, which is hereby incorporated by reference. The cartridge 82 also includes a motor 102 coupled to the linkage 96, and motor control circuitry 104 for controlling the speed of the motor 102 for rotating the rotor 92 of the modulator 80 at the proper speeds to effect the desired acoustic signal modulation. The motor 102 is a conventional two-phase AC induction motor which, in the preferred embodiment, is driven at 60 Hz by the motor control circuitry 102. Use of an induction motor for the motor 102 is not critical, as other types of motors, such as a d.c. servomotor, are suitable.

Figure 2:
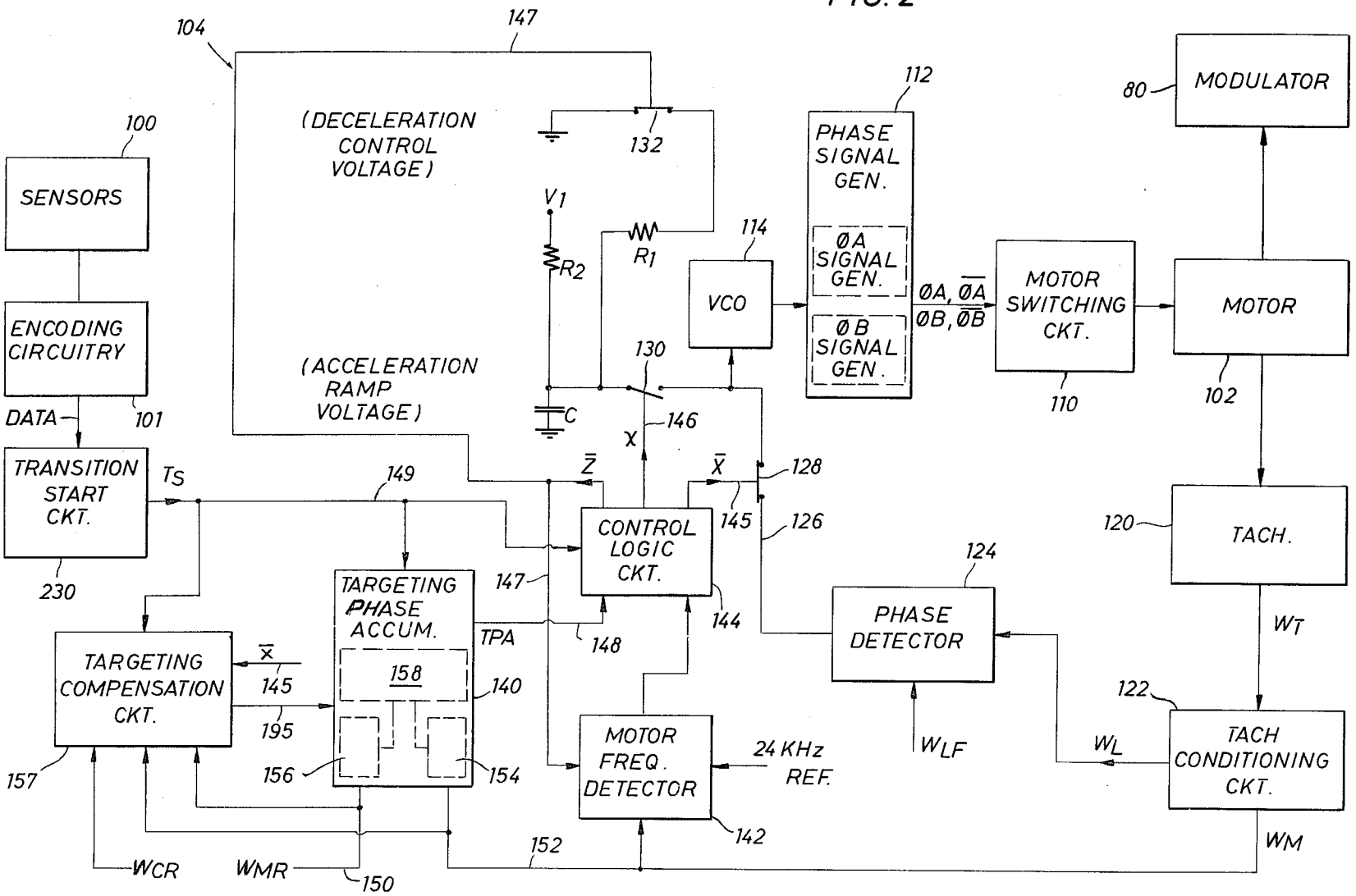
FIG. 2 is a block diagram of downhole telemetering apparatus utilizes in the system of FIG. 1.

The motor control circuitry 104 is shown in relation to the motor 102, to the sensors 100 and encoding circuitry 101 and to the modulator 80 in FIG. 2. The motor control circuitry 104 includes circuitry (1) for maintaining the substantially constant carrier frequency of the acoustic signal transmitted in the drilling mud at the proper phase and (2) for changing the frequency of the acoustic signal and returning it to the carrier frequency to thereby change the phase thereof by a predetermined value as rapidly as possible in response to the encoded data. In the preferred embodiments wherein the data from the sensors 100 is encoded in binary, the phase change is one of 180°.

The motor control circuitry 104 includes a motor switching circuit 110, such as a conventional dc-ac inverter, for supplying two-phase power to the two-phase motor 102.

A phase signal generator 112 and a voltage controlled oscillator (VCO) circuit 114 are provided to generate to the motor switching circuit 110 a pair of phase signals $\phi A$, $\phi B$ and their complements $\overline{\Phi A}$, $\overline{\Phi B}$. The phase signals are 90° out of phase from one another. The voltage control oscillator circuit 114 is conventional, and the phase signal generator 112 includes conventional circuitry for generating approximately 50 percent duty cycle wave forms and their complements. In the preferred embodiment the VCO circuit 114 operates at slightly higher than 240 Hertz during carrier frequency operation. This frequency accounts for inherent "slip" of the induction motor 102 and provides a frequency multiplication factor of four necessary for the phase signal generator 112 to provide the phase signals $\phi A$, $\phi B$ at the desired 60 Hertz frequency. For convenience of description, the slip of the motor will hereafter be assumed negligible.

In the preferred embodiment the circuitry for maintaining the carrier frequency and phase of the acoustic signal in the absence of selected data signals, in combination with the motor switching circuit 110, the phase signal generator 112, and the voltage controlled oscillator circuit 114, advantageously implements a phase locked loop circuit.

The phase and frequency maintaining circuitry includes a tachometer 120 coupled to the motor 102 for producing a series of pulses whose repetition rate is indicative of the frequency at which the motor 102 is driven. In the preferred embodiment the tachometer 120 is selected to generate six cycles per revolution of the motor. The ratio in combination with the design of the modulator 80, the design of the drive linkage 96, and the 60 Hz speed of the motor 102, results in the generation of an acoustic signal within the drilling mud having a 12 Hz carrier frequency and in the generation of a tachometer output signal $\omega_T$ having a 360 Hz frequency.

A tachometer signal conditioning circuit 122 is coupled to the output of the tachometer 120 for providing a relatively low frequency loop frequency signal, $\omega_L$, and a relatively high frequency motor frequency signal $\omega_M$. For example, the loop frequency signal $\omega_L$ is produced at a 24 Hz frequency and the motor frequency signal $\omega_L$ is produced at a 720 Hz frequency when the motor is operating at 60 Hz. The conditioning circuit 122 is conventionally implemented using zero crossing circuitry and frequency multiplying/dividing circuitry.

Completing the phase locked loop circuitry is a phase detector circuit 124. The phase detector circuit 124 is responsive to the loop frequency signal $\omega_L$, and to a 24 Hertz loop reference frequency signal $\omega_{LF}$ to selectively generate a VCO control signal on a line 126 which is operatively coupled to the VCO circuit 114 via a loop switch 128. The phase detector 124 is conventional and may include a set/reset flip-flop (not shown) responsive to the signals $\omega_L$, $\omega_{LF}$ and a low pass filter (not shown) coupled to the output of the flip-flop. The output of the detector 124 generates the VCO control signal as a function of the difference per loop cycle between the $\omega_L$ and $\omega_{LF}$ signals to be indicative of the motor 102 deviating from the carrier frequency or phase. In response to the control signal on the line 126, the VCO circuit 114 changes the excitation frequency supplied to the motor 102 via the inverter 110 to return the motor to and maintain it in phase and frequency lock.

The above referred Sexton et al. patent, U.S. Pat. No. 3,870,063 shows and describes another phase locked loop circuit operating on similar principles.

The circuitry for changing the speed of the motor 102 to thereby change the phase of the acoustic signal in response to data from the sensors 100 is implemented digitally in the illustrated and preferred embodiment. The digital implementation effects a frequency and phase change in the acoustic signal rapidly yet in an extremely accurate manner. The size of the package for the motor control circuitry has been reduced over that of previously proposed analog systems due to the digital implementation, and reliability over wide environmental ranges is achieved. However, the invention is also suitably implemented in analog systems if so desired.

As will be described, the circuitry for changing the speed of the motor operates initially to decelerate the speed of the motor 102 and then to accelerate it for accumulating the total phase change of 180°. Although an acceleration/deceleration sequence is operable, the deceleration/acceleration sequence results in the motor 102 operating in a higher torque range and thus in the modulating of the acoustic signal more predictably and in a shorter period of time.

The speed changing circuitry operates the switch 128 and a set of acceleration and deceleration switches 130, 132, which respectively control the voltage input to the VCO circuit 114. In the illustrated embodiment, the acceleration switch 130 has one terminal commonly connected to the input of the VCO circuit 114 and to one terminal of the loop switch 128. It has its other terminal commonly coupled to a ramp voltage producing network and to the deceleration switch 132 via a resistor R1. The ramp voltage need not be limited to a linearally changing voltage. For example it may change substantially exponentially with time. As illustrated an RC timing circuit comprising the series connection of a resistor R2 and capacitor C between a voltage $V_1$ and circuit ground produces an exponentially increasing range voltage. Accordingly, when the loop switch 128 is open, the acceleration switch 130 is in the closed position and the deceleration switch is opened, the input to the VCO circuit 114 is a ramp voltage, effecting an output from the VCO circuit 114 which increases with time and thus effecting acceleration of the motor which is an increasing function with time. This assures that the phase change in the acoustic signal is accomplished as rapidly as possible.

The deceleration switch 132 has one terminal commonly connected to the resistor R1 and thus to the switch 130. It has its other terminal connected to circuit ground. When the acceleration switch 130 is closed and the deceleration switch 132 is in the closed position, the capacitor C, which had been discharged through the resistor R1 to circuit ground by closing of the switch 132, remains discharged. In the preferred embodiment upon closing of the switch 130, the discharged capacitor C produces a voltage level at the input of the VCO circuit 114 which causes the output of the VCO circuit 114 to step down to approximately 180 Hz from its otherwise constant carrier frequency producing output of approximately 240 Hz.

The speed changing circuitry includes a targeting phase accumulator 140, a motor frequency detector 142 and a control logic circuit 144. As will become apparent, use of the motor frequency detector 142 is an outstanding feature which contributes towards minimizing the time period necessary for returning the speed of the motor to the carrier frequency producing speed during actual encoding.

In response to input signals from the targeting phase accumulator 140 and from the motor frequency detector 142, the control logic circuit 144 generates a set of control signals, $\overline{X}$, X, and $\overline{Z}$ on a set of lines 145, 146, 147 to the switches 128, 130, 132 respectively. These signals are generated in a sequence, appropriately initiated by data from sensors 100, which: (1) initially opens the loop switch 128 to take control away from the phase lock loop; (2) closes the acceleration switch 130 (the deceleration switch 132 already having been closed) to cause a low voltage level to be supplied to the VCO circuit 114 to thereby cause rapid deceleration of the motor 102, and thus change the frequency of the acoustic signal to approximately 180 Hz; (3) to open the deceleration switch 132 while leaving closed the acceleration switch 130 to begin acceleration of the speed of the motor 102 back toward the carrier frequency producing speed; and, (4) thereafter to open the acceleration switch 130 and to close the loop switch 128 to return control of the motor 102 back to the phase lock loop when the carrier frequency producing speed has been achieved by the motor 102.

Figure 4:
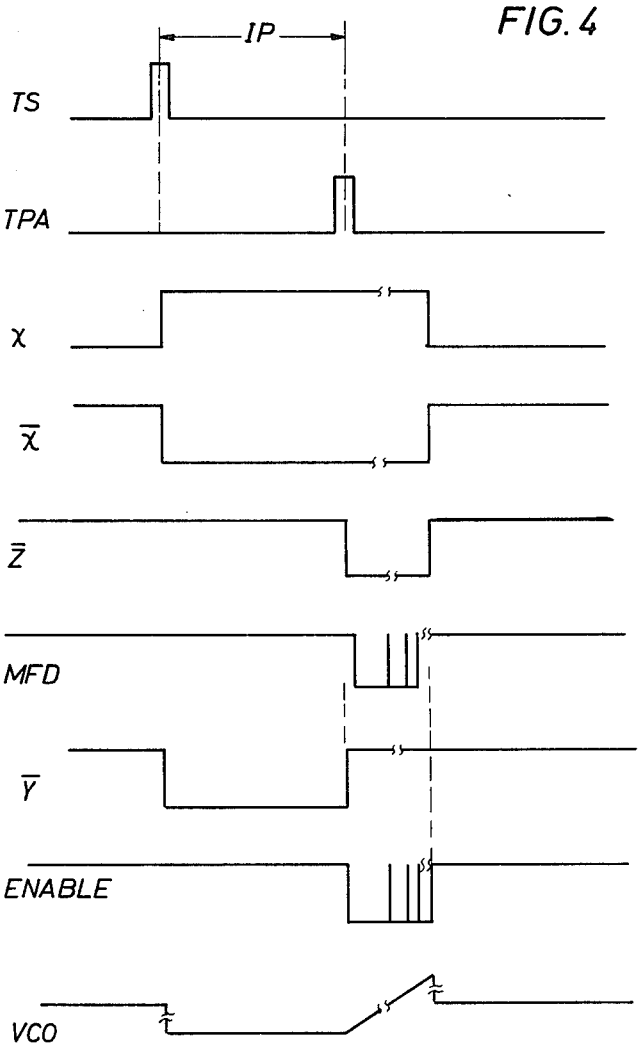
FIG. 4 is a set of exemplary waveforms illustrating operation of the downhole telemetering apparatus.

In more detail and referring to the waveforms depicted in FIG. 4, the targeting phase accumulator 140 generates a TPA control signal on the line 148 a period of time, referred to as the integrating period IP, corresponding to the accumulation of the predetermined amount of phase change, after a transition start (hereafter TS) timing signal has been generated on a line 149. At the beginning of one integrating period, IP, the logic control circuit 144 is actuated to generate the X, $\overline{X}$, and $\overline{Z}$ control signals to open the loop switch 128 and to close the acceleration switch 130 and to maintain closure of the deceleration switch 132, thereby causing deceleration of the motor 102.

In effect, the targeting phase accumulator 140 is a differential integrating circuit. That is, during the integrating period, the targeting phase accumulator 140 effectively is integrating the difference between a 720 Hertz motor reference frequency signal, $\omega_{MR}$, on a line 150 and the motor frequency signal, $\omega_M$, on a line 152. In the illustrated embodiment, the signals $\omega_{MR}$ and $\omega_M$ are integrated. The difference between these integrated values produces an indication of the amount of phase which is being accumulated due to speed changes of the motor 102. When the difference between the integrated values of the signals on the lines 150, 152 reaches a predetermined value due to the deceleration of the motor speed, the targeting phase accumulator 140 generates the TPA signal on the line 146, causing the control logic circuit 144 to open the switch 132. This permits the beginning of the rapid acceleration of the speed of the motor back toward the carrier frequency producing speed.

As above indicated for the illustrated embodiment, the motor reference frequency signal $\omega_{MR}$ on the line 150 is a 720 Hz signal. This results in sixty cycles of the motor reference frequency signal being produced for each cycle of the 12 Hz carrier frequency. Accordingly, thirty cycles of the $\omega_{MR}$ signal correspond to 180° of phase of the 12 Hz carrier.

Since a finite time is required to return the motor speed to the 60 Hz, carrier frequency producing speed, phase shift additional to that effected by the deceleration is accumulated during the return. With a typical load on the motor, it has been ascertained that approximately 65° of carrier phase change is accrued in the process of returning the speed of the motor 102 back from the 45 Hz frequency to the carrier frequency producing speed of 60 Hz. Accordingly, it is necessary to accumulate 115° of phase change in the targeting phase accumulator 140 prior to the generation of the TPA signal and thus of the beginning of the acceleration of the speed of the motor back towards 60 Hz. Since 30 cycles of the $\omega_{MR}$ signal correspond to 180° of carrier phase shift, the targeting phase accumulator 140 needs to accumulate $$115/180 \times 30 = 19 \text{ cycles or counts} \qquad \text{EQN. 1}$$

as the difference between the integrated $\omega_M$ and integrated $\omega_{MR}$ signals. The calculation in EQN. 1 is conditioned upon the characteristic linear relationship between phase loss and phase gain of the acoustic signal as a function of the changing of the motor frequency signal $\omega_M$.

The amount of additional phase accumulated due to return of the motor speed varies with motor loading. However, because the phase and frequency maintaining circuitry operates with inputs at twice the carrier frequency of 12 Hz, it acts to pull the motor speed into lock at 180° of phase change even when the phase changing circuitry results in a range of 91°–269° of phase change. However, as an outstanding feature of the invention as considered in combination with the motor frequency detector 142, and as will be described subsequently, the targeted value of 115° of phase change is updated and modified according to loading conditions on the motor 102. This updating allows the frequency changing circuitry to effect nearly the precise amount of phase change desired when it returns the speed of the motor back to substantially the carrier frequency producing speed, at which time it gives control back to the phase and frequency maintaining circuitry. This minimizes the time period required for the phase locked loop circuit to precisely establish the predetermined amount of phase change in the acoustic signal at the carrier frequency.

In the illustrated embodiment to provide the differential integration the targeting phase accumulator 140 includes a pair of digital accumulator circuits in the form of a motor frequency counter 154 and a tach reference frequency country 156. The motor frequency counter 154 is presettable to a value indicative of a desired amount of phase loss (i.e., the target value of 115°) due to the deceleration of the motor during the integrating period. In the preferred embodiment the counter 154 is preset or updated after every encoding by a targeting compensation circuit 157 for adjusting the target valve according to loading conditions on the motor 102. For purposes of simplifying the description of the targeting phase accumulator, it will be assumed that the targeting compensation circuit 157 is maintaining the target valve of 115; i.e., no changes in the loading of the motor 102 are occurring.

The targeting phase accumulator 140 also includes a digital comparator 158. The digital comparator 158 is coupled to the outputs of the counters 154, 156 and determines when the tach reference frequency counter 156 has been incremented by a value of 19 more than the motor frequency counter 154. Upon this condition, the comparator 158 generates the TPA signal to the motor control logic circuit 144, indicating that the target value of 115° of phase change has been accumulated.

Figure 3:
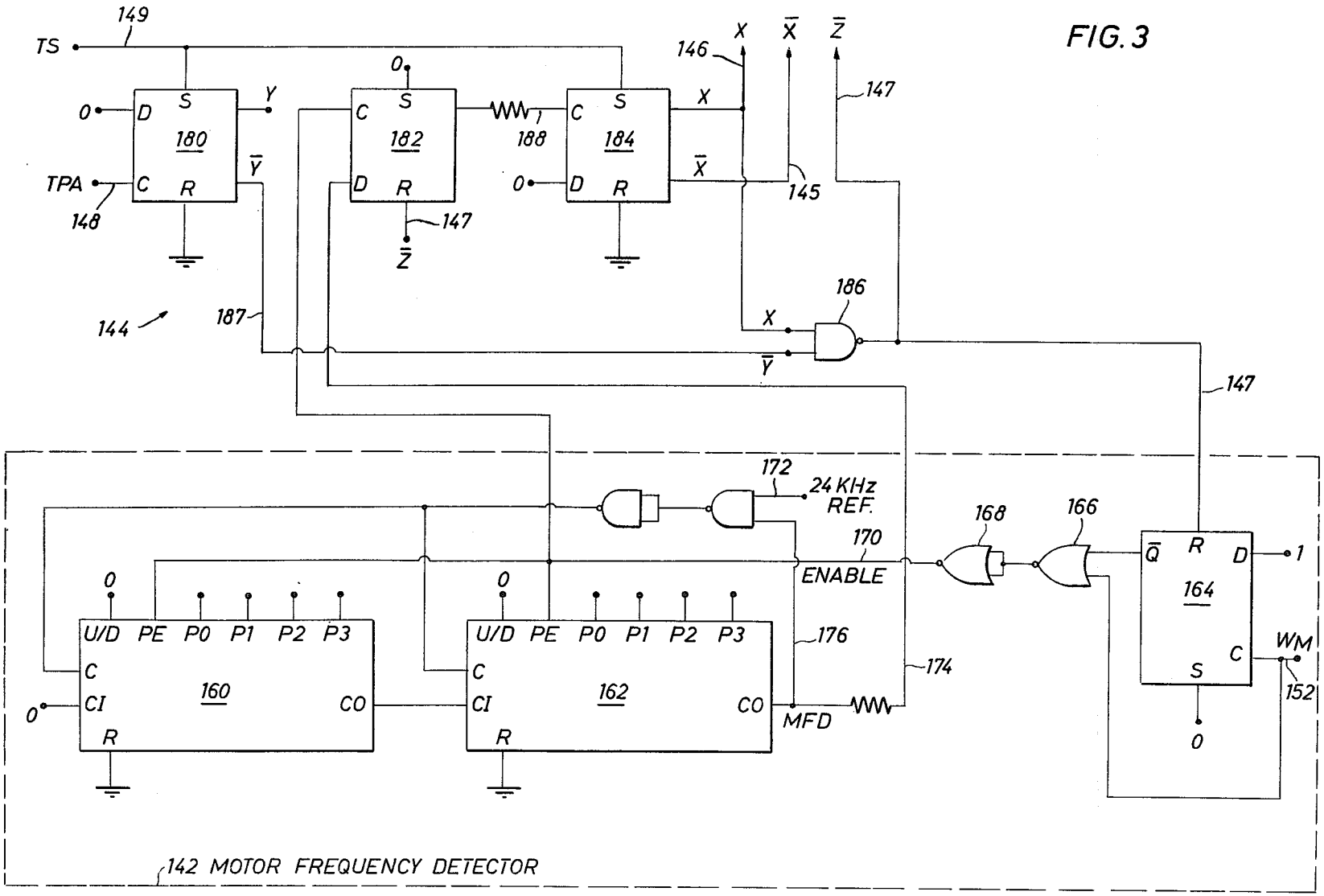
FIG. 3 is a circuit schematic of logic circuitry utilized within the downhole telemetering apparatus of FIG. 2.

The motor frequency detector 142 and the control logic circuit 144, as shown in detail in FIG. 3, effect acceleration of the speed of the motor 102 back to the 60 Hz carrier frequency producing speed. The detector 142 comprises a digital integrator which includes a pair of presettable counters 160, 162 which are coupled to the output of an R/S flip-flop 164. The flip-flop 164 has its clock input coupled to the line 152 for receiving the motor frequency signal $\omega_M$ and generating an ENABLE signal through a pair of gates 166, 168 to the couters 160, 162 via a line 170. The ENABLE signal on the line 170 is generated upon the absence of the $\overline{Z}$ control signal on the line 147 to the reset terminal of the flip-flop 164. The $\overline{Z}$ control signal on the line 147 is removed by the control logic circuit 144 upon generation of the TPA signal (at the end of the integration period IP) on the line 148 from the targeting phase accumulator 140.

Because the motor 102 has been decelerated to a speed less than 60 Hz at the time of the occurrence of the TPA signal, the period of the motor frequency signal $\omega_M$ is longer than normal. The purpose of the presettable counters 160, 162 is to determine when the period of the motor frequency signal $\omega_M$ is indicative that the speed of the motor has been accelerated back to 60 Hz after generation of the TPA signal. To this end, the counters 160, 162 have preset lines (not shown) which determine the number of counts the counters 160, 162 will achieve when the period of the $\omega_M$ signal is proper for 60 Hz operation. The counters 160, 162 are also responsive to a 24 KHz high frequency reference signal on a line 172 which provides a high frequency clocking signal to the counters for incrementing them. The counters 160, 162 are preset to the value which causes a MFD signal to be generated on a line 174 whenever the 24 KHz reference signal on the line 172 causes the number of counts accumulated by the counters 160, 162 to exceed the preset value. The period of the ENABLE signal on the line 170 is decreasing with time due to the acceleration of the motor. Eventially the MFD signal on the line 174 is not generated for a given period of the ENABLE signal. Upon this condition, the motor 102 is operating once again at the carrier frequency producing speed.

Operation of the motor frequency detector 142 is better understood when considering the control logic circuit 144 as shown in FIG. 3. The control logic circuit 144 includes three R/S flip-flops 180, 182, 184 and a NAND gate 186. The flip-flops 180, 184 respectively generate a $\overline{Y}$ signal on a line 187 and the X and $\overline{X}$ signals on the lines 146, 145. The gate 186 is coupled to the lines 146, 187 for generating the $\overline{Z}$ signal on the line 147 as a function of the X and $\overline{Y}$ signals.

The flip-flops 180, 184 are responsive to the TS timing signal on the line 149 and are set upon the occurrence of data of a predetermined logic state as sensed by the sensors 100. Setting of the flip-flop 184 causes a logic 1 and a logic 0 to be generated as the X and $\overline{X}$ signals, thereby closing and opening the acceleration and loop switches 130, 128 respectively. The flip-flop 180 generates a logic zero as the $\overline{Y}$ signal on the line 187 upon its being set by the TS signal. The $\overline{Y}$ signal is then coupled to the gate 186 for generating a logic one state of the $\overline{Z}$ signal. Upon the occurrence of the TPA signal at the end of the integration period IP, the TPA signal on the line 148 clocks the flip-flop 180, changing the $\overline{Y}$ signal to a logic one. During this interval, the $\overline{Z}$ signal has maintained closed the deceleration switch 132 and has disabled operations of the flip-flop 182 by way of the reset input.

Recapitulating, upon generation of the TS timing signal and thus at the beginning of the integration period IP, the X, $\overline{X}$, and $\overline{Z}$ signals have respectively closed the switch 130, opened the switch 128, and maintained closure of the switch 132, causing deceleration of the motor 102.

At the end of the integration period when the targeting phase accumulator 140 has indicated that the desired 115 degrees of phase has been accumulated, as indicated by the TPA signal on the line 148, the flip-flop 180 changes state. This results as a logic 0 is applied to its data input and the TPA signal is applied to its clock input. This change of state generates a logic 1 as the $\overline{Y}$ signal on the line 187, causing a logic 0 to be generated on the line 147 as the $\overline{Z}$ signal. This opens the deceleration switch 132, ending the deceleration phase of the motor speed change and beginning the acceleration phase.

Referring now additionally to the motor frequency detector 142, as is also illustrated in detail in FIG. 3, when the $\overline{Z}$ signal on the line 147 changes to a logic 0, the flip-flops 164 and 182 become unlatched. A logic 1 applied to the data input of the flip-flop 164 is then clocked thereinto by the motor frequency signal $\omega_M$, producing a logic zero at one input of the gate 166. Another input of the gate 166 receives the $\omega_M$ signal on the line 152. The gates 166, 168 thereby generate the ENABLE signal on the line 170 to the counters 160, 162 for presetting them at the beginning of every cycle of the $\omega_M$ signal. The counters then begin counting at a 24 kHz rate, as determined by the 24 kHz signal on a line 172.

At the end of the ENABLE signal, i.e., at the end of one cycle of the motor frequency signal $\omega_M$, if a carry has occurred out of the counter 162, i.e., if a logic 0 has been generated on the line 174 as the MFD signal, the flip-flop 182 remains in the reset state (having been placed into the reset state by the $\overline{Z}$ signal on the line 147 upon the occurrence of the X signal going to the logic zero state, indicating the end of the modulation). Only upon the conditions that a logic 1 is provided on the line 174 to the flip-flop 182 when a logic 1 ENABLE signal occurs will a clock signal be provided via a line 188 to the flip-flop 184. Unless a clock signal is provided via the line 188, the flip-flop 184 maintains the X and $\overline{X}$ signals in the logic 1, logic 0 states as respectively set by the TS timing signals.

When the counters 160, 162 indicate that the period of the ENABLE signal, i.e., the period of one cycle of the motor frequency signal $\omega_M$ has been reduced to a value corresponding to a motor frequency of 60 Hz, no carry out of the counter 162 will occur. The logic 1 needed to change the state of the flip-flop 182 upon the next occurring ENABLE signal is thereupon generated. This provides a clock signal to and changes the state of the flip-flop 184, which in turn changes the states of the X and $\overline{X}$ signals, thereby closing the loop switch 128 and opening the acceleration switch 130.

It is understood that, when viewing the MFD signal as depicted in FIG. 4 in connection with the above description, the value of the MFD signal is a logic 1 state during counting by the counters 160, 162. Because this time period is very small and the time scale of FIG. 4 is relatively large, these pulses appear as spikes. Also, the breaks in the MFD and ENABLE signals indicate that, when the motor 102 is back to full speed and the MFD signal remains in a logic 1 state due to changes to a logic 1 state in which it remains until the next decoding stage.

For purposes of simplifying the description of the phase and frequency maintaining circuitry and of the carrier frequency maintaining circuitry, it has heretofore been assumed that the targeting compensation circuit 157 has been maintaining the target value of the targeting phase accumulator 140 at a constant 115 degrees of phase. This corresponds to no changing in the loading on the motor 102. During actual well drilling operations, however, there are loading changes on the motor 102. These loading changes are quasi-static in that they usually change only very slowly with time. The targeting compensation circuit 157 detects these changes in loading on the motor 102 and adjusts the preset of the targeting phase accumulator 140, i.e., the targeting value heretofore identified as 115 degrees, to cause the total phase shift provided by first the deceleration and then the acceleration of the motor during encoding to be the total desired amount. Because the compensation circuit operates continuously, no prior knowledge of the loading conditions on the motor 102 is necessary.

Figure 5:
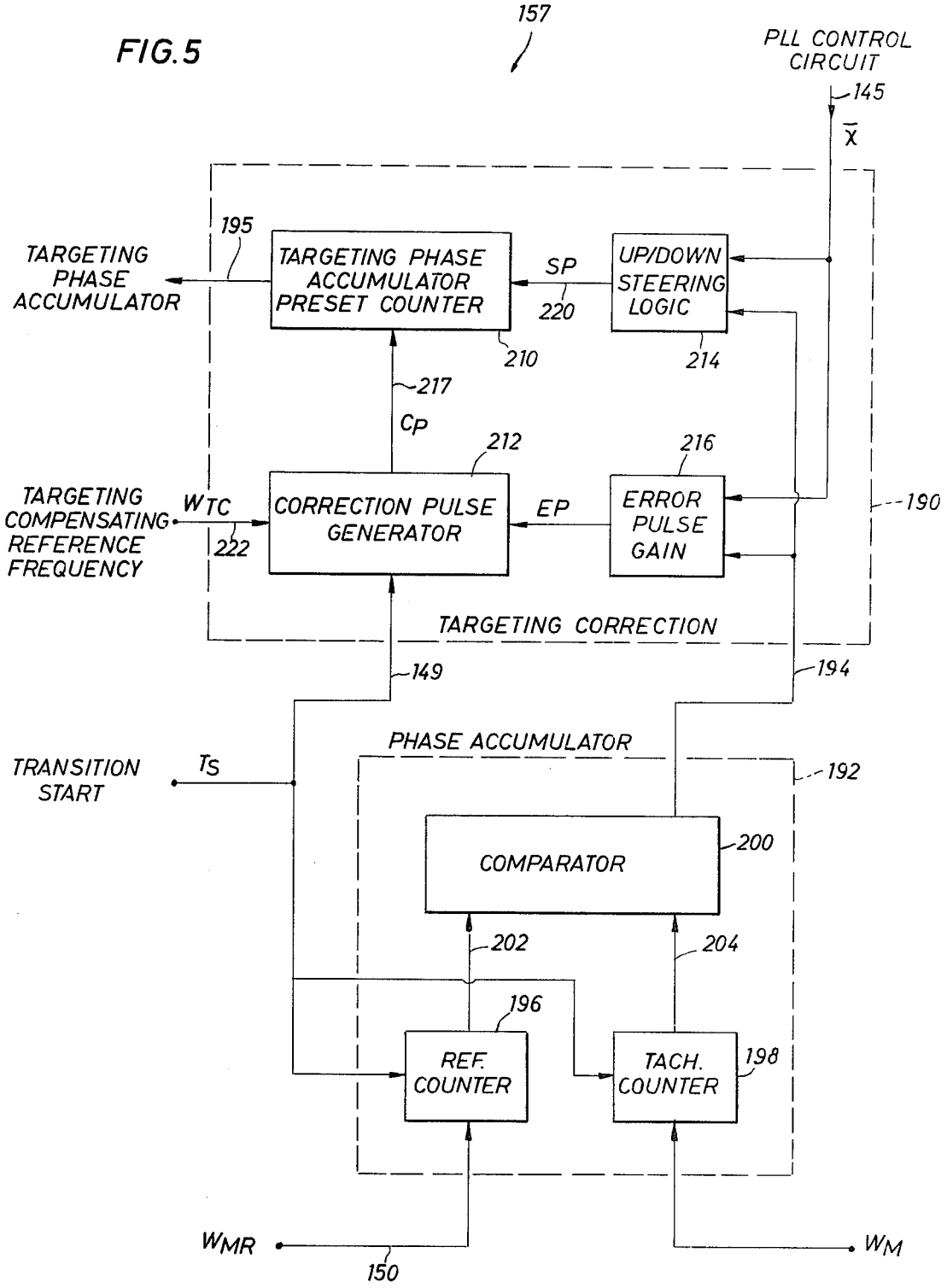
FIG. 5 is a functional block diagram depicting targeting compensation circuitry utilized in the apparatus of FIG. 3.

Referring now to FIG. 5, the targeting compensation circuit 157 includes a targeting correction circuit 190 and an end of transition (EOT) phase accumulator 192. The EOT phase accumulator 192 computes the total amount of phase accumulated during each encoding, i.e., that which is caused by the deceleration and acceleration of the motor 102, and generates an EOT signal on a line 194 to the targeting correction circuit 190 when the desired total phase shift for the encoding has been accumulated. In the illustrated and preferred embodiment, this phase shift is 180 degrees for binary encoded data. The targeting correction circuit 190 is responsive to the EOT signal and adjusts the preset value of the targeting phase accumulator 140 via a line 195 according to whether more or less than 180 degrees of phase has been accumulated by the accumulator 192.

The EOT phase accumulator 192 is in effect another differential integrator circuit similar to that implemented for the targeting phase accumulator 140. The accumulator 192 generates the EOT signal when the difference between the integrated motor reference frequency signal $\omega_{MR}$ and the motor frequency signal $\omega_M$ exceeds a predetermined value corresponding to the total desired amount of phase change. In the illustrated and preferred embodiment, the differential integrating circuit includes a reference counter 196, a tachometer counter 198, and a comparator 200.

The reference counter 196 is responsive to the motor reference frequency signal $\omega_{MR}$ on the line 150 and to the TS timing signal on the line 149 for generating an integrated motor reference frequency signal on a line 202 to the comparator 200. The integrated motor reference frequency signal is indicative of the value of the carrier frequency integrated over the time period beginning upon the occurrence of the TS signal, i.e., upon the occurrence of selected data from the encoding circuitry 101. The TS timing signal resets the counter 196 at the beginning of each IP integration period.

The tachometer counter 198 is responsive to the motor frequency signal $\omega_M$ and to the TS timing signal for producing an integrated motor frequency signal on a line 204. The integrated motor frequency signal $\omega_M$ is indicative of the value of the instantaneous motor speed integrated over the IP integration period beginning upon the occurrence of each TS timing signal. Similarly to the reference counter 196, the tachometer counter 198 is reset by the TS signal. Although not shown, the tachometer counter 198 is a programmable counter and has programming inputs set to a value corresponding to a 180 degrees phase shift. According to the described system, this value is a count of thirty. Presetting of the tachometer counter 198 allows a difference of 180° of phase to be indicated when the integrated signals on the lines 202, 204 achieve the same digital value.

The comparator 200 is coupled to the lines 202, 204 for detecting when the digital values of the integrated signals from the counters 196, 198 become equal. This indicates that 180 degrees of phase has been accumulated in the acoustic signal due to operation of the frequency changing circuitry. A latch circuit (not shown) is coupled to the output of the comparator 200. Upon the condition that the digital values become equal, the comparator 200 set the latch circuit for generating the EOT signal on the line 194. The latch circuit is reset by the TS timing signal.

The targeting correction circuit 190 includes a preset counter 210, a correction pulse generator 212, up/down steering logic 214, and an error pulse generator 216. The targeting correction circuit 190 is responsive to the EOT signal on the line 194 and to the X signal on the line 145 for generating a signal on the line 195 which updates the preset value of the motor frequency counter 154 in the targeting phase accumulator 140 according to whether more of less than 180 degrees of phase shift has been accumulated during the encoding. Accordingly, the motor loading compensation for one encoding is based on a previous encoding; or, stated in other terms, the correction for motor loading during a given encoding is compensation for the next occurring encoding.

The preset counter 210 is a conventional up/down counter implemented using a pair of serially connected, four bit, up/down counters. The preset counter 210 receives a clock pulse on a line 217 from the correction pulse generator 212 whenever the total accumulated phase shift during an encoding differs by more than a predetermined value from the targeted value of 180°. In the illustrated embodiment, because each count of the motor frequency counter 154 corresponds to 6 degrees of phase shift accumulated, each CP pulse generated to the preset counter 201 either increments or decrements the target value of the motor frequency counter 154 by 6°. Whether the counter 210 increases or decreases in value depends upon a steering pulse SP generated on a line 220 from the up/down steering logic 214.

The correction pulse generator 212 includes a pair of serially connected four bit binary counters which are reset by the TS timing signal. The counters are responsive to a targeting compensation reference frequency signal $\omega_{TC}$ on a line 222 and to an error pulse, EP from the error pulse generator 216. When the error pulse EP is of a sufficient duration according to the frequency of the $\omega_{TC}$ signal, a pulse is generated from the output of the counters to provide the CP clock pulse to the preset counter 210. The CP pulse is also coupled to the counters for resetting them. Accordingly, by choosing any of various frequencies for the $\omega_{TC}$ signal, the amount of overshoot or undershoot of the accumulated phase shift which triggers adjustment of the targeting value of the preset counter 210 is adjustable. In the preferred embodiment a frequency of approximately 380 Hz is used for the targeting compensation reference frequency signal $\omega_{TC}$.

The error pulse generator 216 is responsive the the $\overline{X}$ signal on the line 145 and to the EOT signal on the line 194. In the preferred embodiment the generator 216 is an EXCLUSIVE-OR circuit for producing the EP signal having a pulse width indicative of the time difference between the returning of control to the phase and frequency and maintaining circuitry (as indicated by the change of state of the $\overline{X}$ signal) and achieving of the 180° total phase (as indicated by the EOT signal). The time difference translates into a specific number of degrees of phase shift which either exceeds or is less than the targeted value of 180 degrees.

The up/down steering logic 214 is responsive to the EOT signal on the line 194 and to the $\overline{X}$ signal on the line 145 for generating the SP signal on the line 220. The up/down steering logic in the preferred embodiment is an RS flip-flop having its clock terminal coupled to receive the $\overline{X}$ signal, having a logic 1 impressed on its data input terminal and which is reset by the EOT signal. Accordingly, the SP signal on the line 220 is generated as either a logic 1 or logic 0 depending on which of the $\overline{X}$ or EOT signals first occurred, thereby indicating whether control has been returned to the phase and frequency maintaining circuit, i.e., the phase lock loop, before or after 180° of phase has been accumulated.

Referring again to FIG. 2 the TS timing signal is produced is a conventional way by a transition start circuit 230. The transistion start circuit 230 generates a pulse as the TS timing signal upon the occurrence of data of a predetermined logic state as sensed by the sensors 100 and encoded by the encoding circuitry 101. In the illustrated and preferred embodiment, the encoding circuitry 101 encodes the data from the sensors 100 into binary and the transition start circuit 230 detects whenever a logic 1 signal has been encoded by the encoding circuit 101 and generates the TS timing signal accordingly.

The transistion start circuit 230 is suitably described in the above-referenced Sexton et al. patent, U.S. Pat. No. 3,820,063, which previously has been incorporated by reference.

As above described, it thus will be apparent that motor speed detection during encoding, whether taken singularly or in combination with motor loading combination, is an outstanding aid in reducing systems inaccuracies and/or in increasing the speed of data transmission.

Although a preferred embodiment of the invention has been described in a substantial amount of detail, it is understood that the specificity has been for example only. Numerous changes and modifications to the circuits and apparatus will be apparent without departing from the spirit and scope of the invention.

What is claimed is:

1. In a measuring-while-drilling system including a motor driven acoustic generator for imparting to well fluid an acoustic signal having an intermittently constant frequency, and including speed changing means for momentarily changing the speed of the motor to effect a desired amount of change in the phase state of the signal thereby to provide modulated data states to the signal, the speed changing means including a control circuit comprising:

means for generating an instantaneous motor speed signal representative of the instantaneous speed of the motor;

first means for changing the speed of the motor in a first direction;

means responsive to the instantaneous motor speed signal for generating a pair of signals, the difference between which is indicative of the change in phase of the acoustic signal caused by the changing of the motor speed;

means for generating a control signal when said difference reaches a value which is less than said desired amount of phase change;

second means responsive to the control signal and to an end-of-return signal for changing the speed of the motor in a second direction to thereby accumulate at least partially the remainder of said desired amount;

means responsive to said instantaneous motor speed signal for generating said end-of return signal when the speed of the motor has been returned to the speed corresponding to said constant frequency, wherein said second means is responsive to said end-of-return signal for stopping said speed change.

2. The measuring-while-drilling system according to claim 1 wherein said first means includes circuitry for decelerating the speed of the motor to a first relatively low value, and wherein said second means includes circuitry for accelerating the speed of the motor by exciting said motor with a function which changes with time to thereby return said speed to the constant speed.

3. The measuring-while-drilling system according to claim 1 wherein the system further includes a maintaining circuit for precisely adjusting said speed of the motor to maintain a referenced phase at the constant frequency;

wherein said first means includes circuitry for generating a signal disabling said maintaining circuit; and wherein said second means has circuitry for generating a signal enabling said maintaining circuit upon generation of said end-of-return signal.

4. The measuring-while-drilling system according to claim 1 wherein the means for generating a control signal includes:

(a) an accumulator programmable to establish said value and which is responsive to said pair of signals for generating said control signals; and (b) targeting compensation means which is responsive to said difference of the pair of signals and which is coupled to said accumulator for programming said value as a function of the phase accumulated during a previously occurring modulation of the acoustic signal.

5. The measuring-while-drilling system according to claim 1 wherein the means for generating a control signal includes an accumulator programmable to establish said predetermined value and which is responsive to said pair of signals for generating said control signals.

6. In a measuring-while-drilling system including an acoustic generator having a moveable member adapted to be disposed within drilling fluid and driven at speeds for imparting to the drilling fluid a modulated signal having phase states representative of encoded data signals derived from measured downhole conditions, and further including frequency maintaining control means for driving the moveable member at a substantially constant rate to effect a substantially constant carrier frequency in the acoustic signal, frequency changing control means for temporarily changing the rate of the member to effect a predetermined phase change in the acoustic signal according to the data, wherein the rate of movement of the member is changed in a first direction until a prescribed amount of said predetermined phase change is achieved and wherein the rate of movement is changed in the opposite direction for accumulating the remainder of said predetermined phase change, the improvement wherein the frequency changing control means comprises:

first for changing the rate of movement of the member from the constant rate to a different rate substantially upon the occurrence of an encoded data signal;

a differential integrating circuit for generating a control signal when a value is exceeded by the difference between (1) an integrated carrier frequency signal representative of the value of the constant carrier frequency integrated over a time period beginning substantially upon the occurrence of one data signal, and (2) an integrated rate signal indicative of the value of the instantaneous rate of movement of the member integrated over said time period;

means for generating the rate signal representative of the instantaneous rate of movement of the member;

second means responsive to the control signal and to an end-of-return signal for changing the rate of movement of the member in said opposite direction to return it to said substantially constant rate, said end-of-return signal being effective to disable said second means; and rate detection means responsive to the rate signal for generating said end-of-return signal when the rate of movement of the member becomes substantially equal to said substantially constant rate.

7. The measuring-while-drilling system according to claim 5 wherein the rate detection means includes an accumulator circuit which is responsive to said rate signal.

8. The measuring-while-drilling system according to claim 7 wherein said accumulator circuit comprises a programmable counter having a clocking input coupled to receive a high frequency reference signal and having an enable terminal coupled to said rate signal.

9. The measuring-while-drilling system according to claim 8 wherein said accumulator circuit further includes circuitry coupled to the counter and responsive to said rate and reference signals for effecting generation of said end-of-return signal when the period of said rate signal equals a selected number of cycles of said frequency signal.

10. The measuring-while-drilling system according to claim 6 wherein said frequency maintaining control means comprises a phase locked loop circuit which controls the rate of movement of the moveable member after generation of said end-of-return signal.

11. The measuring-while-drilling system according to claim 6 wherein said first means includes a signal producing network for effecting deceleration of the rate of movement from said substantially constant rate and wherein said second means includes a signal producing network for effecting acceleration of the rate of movement back to said substantially constant rate.

12. The measuring-while-drilling system according to claim 11 and including a motor for driving the member and wherein the signal producing network of said second means includes a ramp signal generator for effecting excitation of said motor as a function which is changing with time to thereby minimize the time needed to return the rate to said substantially constant rate.

13. The measuring-while-drilling system according to claim 6 wherein said differential integrating circuit includes:

an accumulator programmable to establish said value and which is responsive to said integrated signals for generating the control signal; and targeting compensation means coupled to said accumulator for programming said value in response to the rate at which the moveable member was driven during a previously occurring modulation of the acoustic signal.

14. The measuring-while-drilling system according to claim 5 wherein said differential integrating circuit includes an accumulator programmable to establish said predetermined value and which is responsive to said integrated signals for generating the control signal.

15. A well measuring-while-drilling system for measuring downhole conditions and coupling a modulated acoustic signal representative thereof to drilling fluid within the well and including measuring apparatus adapted to be connected to a drill string and disposed in the well, the measuring apparatus including one or more sensors for sensing the downhole conditions and generating encoded sensor signals representative thereof, and an acoustic generator responsive to the sensor signals for imparting to the drilling fluid an acoustic signal representative of one or more of the downhole conditions; the improved acoustic generator comprising:

(a) a rotary valve transmitter having a rotor disposed for selectively interrupting the downward passage of the drilling fluid to thereby generate the modulated acoustic signal;

(b) a tachometer-equipped motor for rotating said rotor and generating a motor frequency signal representative of the speed of the acoustic generator;

(c) a control circuit coupled to the sensor and to the motor for controlling energization of the motor in response to the sensor signals, thereby to effect periodic interruption of the drilling fluid by the rotor, the control circuit including a phase and frequency maintaining circuit operative to drive the motor at a substantially constant speed to thereby effect the acoustic signal to have a constant carrier frequency and a reference phase in the absence of a sensor signal of a predetermined value, and a modulation control circuit operative in response to said predetermined value of said sensor signal to momentarily decelerate the speed of the motor and then, upon generation of a control signal, to accelerate the speed of the motor until generation of an end-of-return signal, to thereby provide the acoustic signal to have a changed phase value relative to said reference phase, said modulation control circuit including (i) first circuit means operable to excite said motor for generating a carrier frequency;

(ii) second circuit means for generating said control signal when the difference between integrated values of the carrier and motor frequency signals reach a predetermined value, thereby representative of the difference between said first and second phase values reaching a selected value during said momentary change in frequency; and (iii) rate detection means responsive to said motor frequency signal for generating said end-of-return signal when the rate of movement of said member becomes substantially equal to said constant rate.

16. The measuring-while-drilling system according to claim 13 wherein said modulation control circuit includes a ramp signal generator to effect excitation of said motor during the accuration as a function which is changing with time.

17. The measuring-while-drilling system according to claim 15 wherein said motor is subject to loading conditions which influence its speed during the speed changes which define modulation, and wherein said second circuit means includes:

(a) an accumulator circuit programmable to establish said value and which is responsive to said integrated signals for generating the control signal; and (b) targeting compensating means coupled to said accumulator circuit for programming said value in response to loading conditions on said motor during a previously occurring modulation of the acoustic signal.

18. The measuring-while-drilling system according to claim 15 wherein said motor is subject to loading conditions which influence its speed during the speed changes which define modulation, and wherein said second circuit means includes an accumulator circuit programmable to establish said predetermined value and which is responsive to said integrated signals for generating the control signal.

19. In a measuring-while-drilling system including a motor driven acoustic generator for imparting to well fluid an acoustic signal having an intermittently constant frequency, the method of momentarily changing the speed of the motor to effect a desired amount of change in the phase state of the signal thereby to provide modulated data states to the signal, comprising the steps of:

(a) generating a motor speed signal representative of the instantaneous speed of the motor;

(b) changing the speed of the motor in a first direction;

(c) stopping said motor speed change in the first direction when a value of phase shift which is less than the desired change in phase has been accumulated;

(d) changing the speed of the motor in a second direction to accumulate at least partially the remainder of said desired amount;

(e) generating an end-of-return signal in response to the motor speed signal when the speed of the motor has been returned to the speed corresponding to said constant frequency; and (f) stopping said speed change in response to said end-of-return signal.

20. The method according to claim 19 wherein:

(a) the step of changing the speed of the motor in a first direction includes the step of initially decelerating the speed of the motor to a first relatively low value; and, (b) the step of changing the speed of the motor in a second direction includes the step of accelerating the speed of the motor by exciting said motor as changing-with-time function to thereby return said speed to said constant speed.

21. The method according to claim 19 wherein said system includes a control circuit for precisely adjusting said speed of the motor to maintain a reference phase at the constant frequency and further including the steps of (a) disabling operation of said control circuit during said steps of changing; and (b) enabling operation of said control circuit upon generation of said end-of-return signal.

22. The method according to claim 19 wherein the step of changing the speed in the first direction further includes the steps of (a) generating a pair of digital signals, the difference between which is indicative of the change in phase of the acoustic signal caused by the changing of the motor speed; and, (b) wherein said step of changing the speed in the second direction is initiated when the difference between said digital signals reaches a predetermined value.

23. The method according to claim 19 wherein the motor is subject to loading conditions which influence its speed during the speed changes which define a modulation, and wherein the method further includes the step of adjusting said value of said phase shift as a function of motor speed during a previous modulation of the acoustic signal.

24. In a measuring-while-drilling system including a downhole acoustic generator having a moveable member driven for imparting to well fluid an acoustic signal having an intermittently constant frequency, the method of momentarily changing the rate of movement of the member to effect a desired amount of change in the phase state of the signal, thereby to provide encoded data states to the signal, comprising the steps of:

(a) generating a rate signal representative of the instantaneous rate of the member;

(b) changing the rate of movement of the moveable member in a first direction away from the constant frequency producing rate;

(c) stopping said step of changing in the first direction when a predetermined phase shift which is less than the desired change in phase has been accumulated;

(d) changing the rate of movement of the member in a second direction towards the constant frequency producing rate to accumulate at least partially the remainder of said desired amount;

(e) generating an end-of-return signal in response to said rate signal when the rate of the member has been returned to said constant frequency producing rate; and (f) terminating said step of changing the rate of movement of the member in the second direction in response to said end-of-return signal.

25. In a measuring-while-drilling system including a motor driven acoustic generator for imparting to well fluid an acoustic signal having an intermittently constant frequency, and including speed changing means for momentarily changing the speed of the motor to change the frequency of the acoustic signal from the constant frequency to another frequency and back to the constant frequency to effect a desired amount of change in the phase state of the signal thereby to provide modulated data states to the signal, the improvement wherein the speed changing means includes:

first means for generating a motor speed signal representative of the instantaneous speed of the motor;

second means responsive to the motor speed signal for generating an end-of-return signal during said momentary speed change when the motor speed has been returned to the speed corresponding to the constant frequency; and third means responsive to the end-of-return signal for terminating said speed change when the motor speed has been returned to the speed corresponding to said constant frequency.

* * * * *

UNITED STATES PATENT OFFICE

CERTIFICATE OF CORRECTION

Patent No. 4,103,281 Dated July 25, 1978

Inventor(s) Gerald A. Strom and James I. Bernard

It is certified that error appears in the above-identified patent and that said Letters Patent are hereby corrected as shown below:

Column 2, line 13, "conduit" should read -- constant --.

Column 4, line 41, "utilizes" should read -- utilized --.

Column 5, line 52, "meansingful" should read -- meaningful --.

Column 7, line 56, the second "The" should read -- This --.

Column 9, line 68, "values" should read -- signals --.

Column 14, line 48, "X" should read -- $\overline{X}$ --.

Column 17, line 59, "5" should read -- 6 --.

Column 19, line 29, "13" should read -- 15 --.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*